US006236417B1

(12) United States Patent
Fujii et al.

(10) Patent No.: US 6,236,417 B1
(45) Date of Patent: May 22, 2001

(54) ELECTROPHOTOGRAPHIC APPARATUS AND TEST PATTERN RECORDING METHOD

(75) Inventors: Kenichi Fujii, Susono; Seiji Uchiyama, Numazu, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/215,744

(22) Filed: Dec. 17, 1998

(30) Foreign Application Priority Data

Dec. 26, 1997 (JP) ..... 9-359833

(51) Int. Cl.[7] ..... G03G 15/00
(52) U.S. Cl. ..... 347/129; 399/32
(58) Field of Search ..... 347/129, 131, 347/233; 399/9, 15, 31, 32, 72

(56) References Cited

U.S. PATENT DOCUMENTS 5,450,120 * 9/1995 Nishio ..... 347/249
5,774,169 6/1998 Ikegawa et al. ..... 347/262
6,016,204 * 1/2000 Budnik et al. ..... 399/9 X

FOREIGN PATENT DOCUMENTS 0 734 154 9/1996 (EP) .
9-15924 1/1997 (JP) .
10-217539 8/1998 (JP) .

* cited by examiner

*Primary Examiner*—Joan Pendegrass
(74) *Attorney, Agent, or Firm*—Fitzpatrick, Cella, Harper and Scinto

(57) ABSTRACT

In an optical printer which performs image recording by using plural laser beams, there is a case where abnormality can not be normally confirmed even if a test pattern is recorded. In order to prevent such a problem, an electrophotographic apparatus is provided to drive each of the plural laser beams according to inputted image data, and to perform scanning on scan paths mutually different on an identical recording medium with the plural laser beams. In this apparatus, any one of the plural laser beams is driven within a predetermined area to record the test pattern.

26 Claims, 14 Drawing Sheets

/TOPE
301
MASK SIGNAL GENERATION TIMING SETTING REGISTER
302
PHASE SYNC OSCILLATOR
303
MAIN-SCAN COUNTER
304
COMPARATOR
305
306
CLR
COUNTER
CK
307
/MASK
324
325
326
321
322
323
CLK
310
MULTIPLEXER
320
330
331
/BD1
/BD2
332
SEL
311
D
Q
333
327
312
DE-MULTIPLEXER
/TEST PATTERN1
334
335
/TEST PATTERN2

ELECTROPHOTOGRAPHIC APPARATUS AND TEST PATTERN RECORDING METHOD

BACKGROUND OF THE INVENTION

1. Field of the Invention

The present invention relates to an electrophotographic apparatus for performing image formation by using plural light beams, which apparatus records a test pattern to detect an abnormal state (or wrong state).

2. Related Background Art

In recent years, a so-called multibeam laser printer which performs image formation by using plural light beams, e.g., plural laser beams and obtains a desired image through an electrophotographic process has been studied.

FIG. 12 shows an example of such the multibeam laser printer, and FIGS. 13A to 13I show operation timing of the printer.

In FIG. 12, a laser printer 1 is connected to an external equipment 31 such as a computer or the like, and performs image formation on a recording paper under the control of the equipment 31. The external equipment 31 supplies various control signals and image information to a video controller 27, and the controller 27 outputs a video signal. A print control unit 26 is a control circuit for controlling each unit in the printer 1. When an RDY signal from the external equipment 31 becomes TRUE as shown in FIG. 13A, the video controller 27 sets a PRINT signal TRUE as shown in FIG. 13B. When the PRINT signal becomes TRUE, the print control unit 26 starts to drive a main motor 23 and a polygonal motor 14 as shown in FIGS. 13F and 13G. When the motor 23 is driven, a photosensitive drum 17, fixing rollers of a fixing unit 9 and paper discharge rollers 11 start rotation. Then, the print control unit 26 starts to control a light quantity of a semiconductor laser 13, and also sequentially performs high-voltage driving of a primary charger 19, a development unit 20 and a transfer charger 21.

When a time T1 elapses from a drive start of the polygonal motor 14 and thus rotation of the motor 14 becomes stable as shown in FIG. 13G, the print control unit 26 turns on a paper feed clutch 24 to drive a paper feed roller 5 as shown in FIG. 13H. Thus, a recording paper sheet 3 within a paper feed cassette 2 is fed toward resist rollers 6. At timing when the paper 3 reaches the rollers 6, the unit 26 outputs a VSREQ signal to the video controller 27 as shown in FIG. 13C, and also turns off the clutch 24 to stop driving the roller 5 as shown in FIG. 13H. On the other hand, after the controller 27 expands the image information sent from the external equipment 31 into a dot image and then completes preparation for outputting a VDO signal, the controller 27 confirms that the VSREQ signal in FIG. 13C is TRUE. Then, the controller 27 sets a VSYNC signal TRUE as shown in FIG. 13D. In synchronism with such an operation, after elapsing a time Tv as shown in FIG. 13E, the controller 27 starts to output the VDO signal as image data corresponding to one page.

At this time, the print control unit 26 turns on a resist roller clutch 25 after elapsing a time T3 from rise of the VSYNC signal as shown in FIG. 13I, and drives the resist rollers 6. The rollers 6 are driven for a time T4 as shown in FIG. 13I, i.e., until a trailing edge of the recording paper sheet 3 passes through the rollers 6. During the time T4, the print control unit 26 drives the semiconductor laser 13 according to the VDO signal sent from the video controller 27.

The semiconductor laser 13 comprises lasers A and B which emit two laser beams, i.e., laser beams A and B respectively. The print control unit 26 drives each laser according to each VDO signal. The two laser beams are reflected by a rotating polygonal mirror 15 and then inclined by a mirror 16 in a scanner unit 7, and the inclined beams are guided onto each scan path of the photosensitive drum 17. For example, it is assumed that odd-number lines on the drum 17 are scanned by the laser beam A, while even-number lines are scanned by the laser beam B. As above, when the two laser beams modulated by the respective VDO signals are simultaneously radiated onto the photosensitive drum 17, a latent image is formed on the drum 17 such that two lines are formed by each beam. By repeating such an operation, the latent image of one page is formed on the drum 17. A not-shown beam detector is provided on the scan paths of the laser beams A and B and out of an image formation area. The beam detector detects the beams A and B, and generates /BD1 signal and /BD2 signal respectively corresponding to the beams A and B. Modulation timing of the laser beams is controlled on the basis of these two /BD signals.

The latent image formed on the photosensitive drum 17 is developed by the development unit 20, and then a toner image is transferred onto the recording paper sheet 3 by the transfer charger 21. After the transfer terminates, the paper 3 is carried to the fixing unit 9, and the toner image is fixed to the paper 3. After then, the paper 3 is discharged outward by the paper discharge rollers 11. In case of continuously printing an image of next page, the print control unit 26 again sets the PRINT signal TRUE after elapsing a time T5 as shown in FIG. 13B, and performs the same control as in the printing of the first-page image.

As a test pattern data generation circuit for such the multibeam laser printer, for example, a circuit for generating longitudinal-line test pattern data in a two-beam laser printer will be explained. FIG. 14 shows a structure of this circuit, and FIGS. 15A to 15J show operation timing of this circuit.

Hereinafter, structure and operation of FIG. 14 will be explained. A mask signal generation timing setting register 101 is a register which stores therein timing (=counter value) for releasing a /MASK1 signal 124 and a /MASK2 signal 224 necessary in test printing and timing (=counter value) for generating these signals. A storage operation into the resister 101 is performed at the beginning of the test printing.

In FIG. 14, in order to obtain horizontal synchronism in the test printing, a /BD1 signal 120 has been inputted in a first phase sync oscillator 102 and a first main-scan counter 103.

When the /BD1 signal 120 becomes TRUE as shown in FIG. 15A, the first main-scan counter 103 is initially reset. Subsequently, the first phase sync oscillator 102 generates an image clock signal (CLK1 signal) 121 in synchronism with the /BD1 signal 120 as shown in FIG. 15B. The CLK1 signal 121 is inputted to the first main-scan counter 103 and also to a counter 106 for generating test pattern data. Since the counter 103 counts the number of clock pulses, a first main-scan counter value 122 increases as time elapses. By a first comparator 104, the value 122 is compared with a counter value 123 for releasing a mask set in the mask signal generation timing setting register 101. On the other hand, a value of the counter 106 at this time is kept "0", because a /writing inhibition signal 126 is TRUE and thus the counter 106 is continued to be cleared.

Subsequent to the /BD1 signal 120, a /BD2 signal 220 changes its state from FALSE to TRUE as shown in FIG.

15F. Thus, in the same manner as in the above first main-scan counter 103, a second main-scan counter 203 is reset, a second phase sync oscillator 202 generates a second image clock pulse signal (CLK2 signal) 221 as shown in FIG. 15G, and the counter 203 counts the number of clock pulses. Even in a second comparator 204, a mask release value 223 of the laser B and a second main-scan counter value 222 are compared with each other. As a result, while the value 222 is smaller than the value 223, the /MASK2 signal 224 is kept TRUE.

When the first main-scan counter value 122 reaches the mask release value, a mask of the laser A is released as shown in FIG. 15C, and the /MASK1 signal 124 is inputted to a gate 105.

At this time, when a /TOPE signal 125 being FALSE is inputted to the gate 105, the four-bit first counter 106 starts counting as shown in FIG. 15D. The respective bits counted by the counter 106 are managed as input values into an NAND gate 107 to generate a /TEST PATTERN1 signal 127. When the value of the first counter 106=Fh, the signal 127 becomes TRUE as shown in FIG. 15E.

Also, when the second main-scan counter value 222 reaches the mask release value, a /TEST PATTERN2 signal 227 is generated in the similar manner.

When the first main-scan counter value 122 reaches a mask generation value, the /TEST PATTERN1 signal 127 becomes FALSE. Similarly, the mask is generated for the laser B, and the writing is inhibited. Such a series of operations is repeated until the /TOPE signal 125 becomes TRUE. Thus, a longitudinal-line test pattern is printed on the paper sheet.

Subsequently, examples of abnormal (or wrong) states which are specific to the multibeam laser printer will be explained, and also problems of the above conventional structures will be indicated.

EXAMPLE 1 OF ABNORMAL STATE

Initially, as the abnormal state example being specific when the plural light beams are used, a case where one of the plural light beams is deteriorated and thus does not completely operate will be explained. In the above conventional structure, if the longitudinal lines are outputted to perform the test printing, the test pattern is printed as longitudinal-direction solid lines 53 shown in FIG. 16. That is, in the image of FIG. 16, for example, although a broken line of one-dot space should be essentially formed in a longitudinal direction, such the broken line is not often reproduced completely due to a condition in an electrostatic photographic process. Even if the broken line is reproduced completely, it is very difficult for human eyes to confirm the broken line if recording density of the lines in a sub-scan direction is 600 dpi or so. It is still more impossible almost for the human eyes to specify which beam is abnormal. As above, even if one of the beams is deteriorated and thus does not completely operate, the test pattern is merely recognized as a longitudinal-line pattern of which density is slightly thin, and there is a case where the abnormal state is not detected.

EXAMPLE 2 OF ABNORMAL STATE

Subsequently, as the abnormal state example being specific when the plural light beams are used, a case where abnormality occurs in horizontal sync control will be explained. It should be noted that such the abnormality occurs when, e.g., the BD signal is delayed due to dust on a beam optical path, a scratch on a lens or the like. In the above conventional structure, if the longitudinal lines are outputted to perform the test printing, the test pattern is printed as longitudinal-direction solid lines 65 shown in FIG. 17. In the image of FIG. 17, although it is possible to recognize that something abnormal occurs in the horizontal sync control, it is impossible to specify whether merely timing of the two beams is asynchronous or jitter influences any one of the two BD signals.

EXAMPLE 3 OF ABNORMAL STATE

Subsequently, as the abnormal state example being specific when the plural light beams are used, a case where the light quantities of the plural beams are not uniform will be explained. If the light quantities are not uniform, unevenness in density appears. If it is assumed that a halftone solid-color image is recorded as the test pattern by slightly modifying the above conventional structure, a halftone pattern 83 shown in FIG. 18 can be obtained. That is, merely the obtained pattern becomes slightly thinner as a whole. Therefore, like the above example 1 of abnormal state, it is difficult for the human eyes to discriminate that the density of only the printed result of the specific beam is thin.

Moreover, in a test pattern data generation circuit having such the conventional structure as above, it is necessary to provide a print pattern generation circuit for each of the plural lasers to independently turn on and off each beam, thereby anticipating cost increase.

SUMMARY OF THE INVENTION

The present invention has been made in consideration of the above-described problems, and an object thereof is to generate, in case of generating test pattern data for an electrophotographic apparatus which performs image formation by using plural light beams, the test pattern data by which an abnormal (or wrong) state of the light beam can be accurately detected.

Another object of the present invention is to generate the test pattern data at low cost.

Still another object of the present invention is to record a test pattern by which it is possible to detect which light beam the abnormal state occurs.

To address the above objects, the present invention is an electrophotographic apparatus which includes plural emission means each for emitting a light beam, a drive means for driving each of the plural light beams according to inputted image data, a scan means for performing scanning on scan paths mutually different on an identical recording medium, with the plural light beams, and a generation means for generating test pattern data, the drive means driving each light beam according to the test pattern data to record a test pattern, wherein the drive means drives any one of the plural light beams within a predetermined area to record the test pattern.

A second embodiment of the present invention is an electrophotographic apparatus which includes plural emission means each for emitting a light beam, a drive means for driving each of the plural light beams according to inputted image data, a scan means for performing scanning on scan paths mutually different on an identical recording medium, with the plural light beams, and a generation means for generating test pattern data, the drive means driving each light beam according to the test pattern data to record a test pattern, wherein the apparatus further comprises a selection means for selecting any one of the plural light beams, and the drive means drives, within a predetermined area, the light beam selected by the selection means to record the test pattern.

A third embodiment of the present invention is an electrophotographic apparatus which includes plural emission means for emitting a light beam, a drive means for driving each of the plural light beans according to inputted image data, a scan means for performing scanning on scan paths mutually different on an identical recording medium, with the plural light beams, and a generation means for generating test pattern data, the drive means driving each light beam according to the test pattern data to record a test pattern, wherein plural areas each corresponding to each of the plural light beams are provided, and the drive means drives, within each of the plural areas, the light beam corresponding to such the area to record the test pattern.

A fourth embodiment of the present invention is an electrophotographic apparatus which includes plural emission means each for emitting a light beam, a drive means for driving each of the plural light beams according to inputted image data, and a scan means for performing scanning on an identical recording medium with the plural light beams, wherein a test pattern is recorded in a predetermined area by using any one of the plural emission means.

A fifth embodiment of the present invention is an electrophotographic apparatus which includes plural emission means each for emitting a light beam, a drive means for driving each of the plural light beams according to inputted image data, and a scan means for performing scanning on an identical recording medium with the plural light beams, wherein a test pattern is recorded in each of plural areas by using any one of the plural emission means.

Other objects, structures and effects of the present invention will be apparent from the following detailed description and the accompanying drawings.

DETAILED DESCRIPTION OF THE PREFERRED EMBODIMENTS (First Embodiment)

Figure 1:
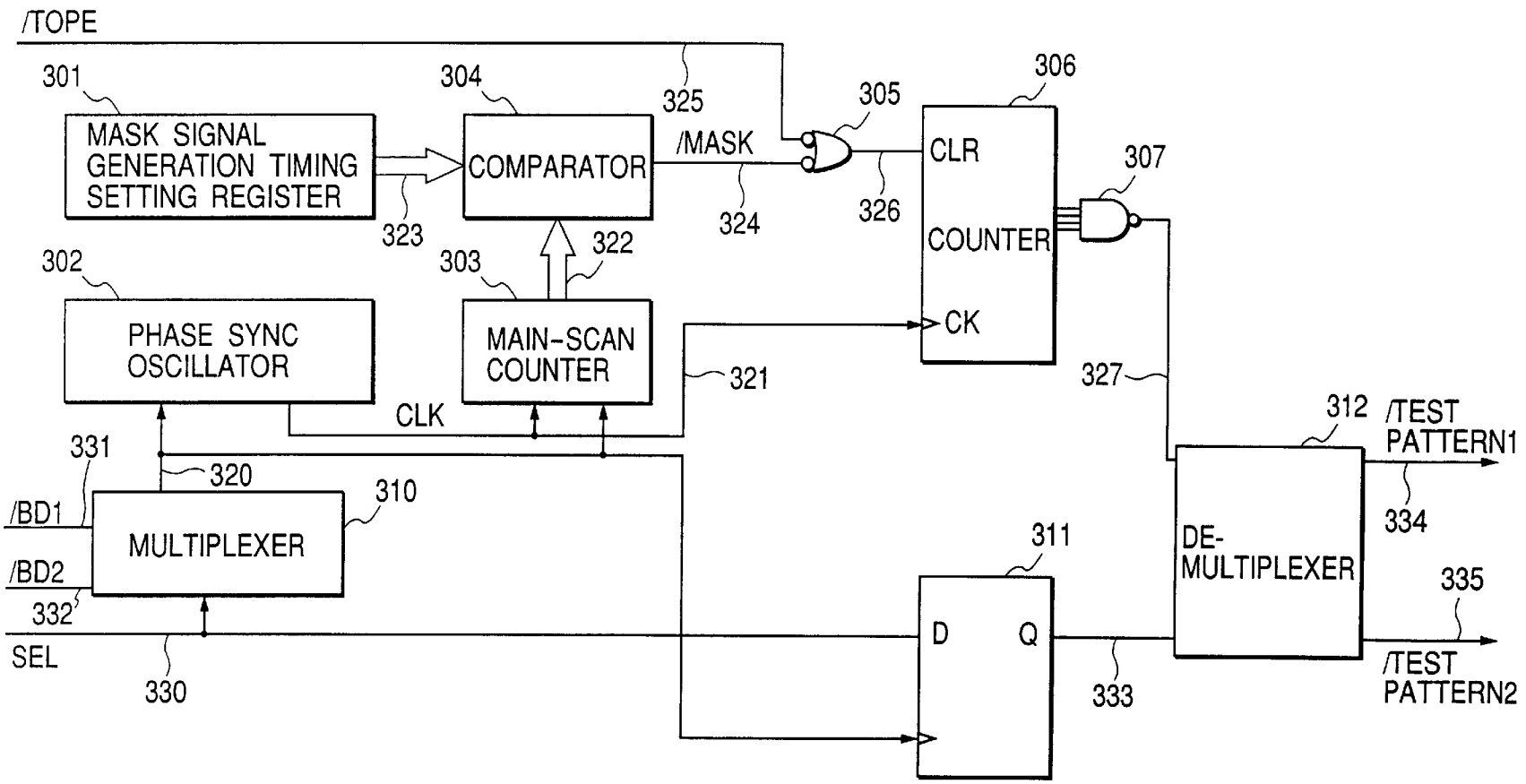
FIG. 1 is a diagram showing a circuit to generate test pattern data according to first and second embodiments of the present invention.

FIG. 1 shows an example of a test pattern data generation circuit by which the present invention is realized in, e.g., a two-beam laser printer using two laser beams. That is, in the first embodiment, it is assumed that a laser A is selected to drive a laser beam A and driving of a laser B is inhibited for, e.g., an upper-half area of a test image, while the laser B is being driven and driving of the laser A is being inhibited for a lower-half area being neighboring to the upper-half area in a sub-scan direction.

In the first embodiment, a longitudinal-line image is recorded by using any one of the lasers in each of the plural areas. It should be noted that an operation of an electrophotographic process in the first embodiment is the same as that in the related background art already explained in FIG. 12.

In FIG. 1, an SEL signal 330 used to select the two lasers and the two laser beams is inputted to a multiplexer 310 and also to a BD signal sync circuit 311.

The multiplexer 310 selects one of a /BD1 signal 331 and a /BD2 signal 332 according to the inputted SEL signal 330, and then inputs a signal 320 to a phase sync oscillator 302, a main-scan counter 303 and the BD signal sync circuit 311. If it is assumed that the SEL signal 330 instructs to select the laser A, the multiplexer 310 selects the /BD1 signal 331. Hereinafter, a case where the SEL signal 330 instructs to drive the laser A will be explained.

In such a state as the laser A is being selected, when the laser beam A passes through a beam detector, the /BD1 signal 331 becomes TRUE. Thus, by using this TRUE signal as a trigger, the phase sync oscillator 302 starts to generate an image clock signal (CLK signal) 321 in synchronism with the /BD1 signal 331. The CLK signal 321 is then inputted to the main-scan counter 303 and also to a counter 306 for generating test pattern data.

Figure 12:
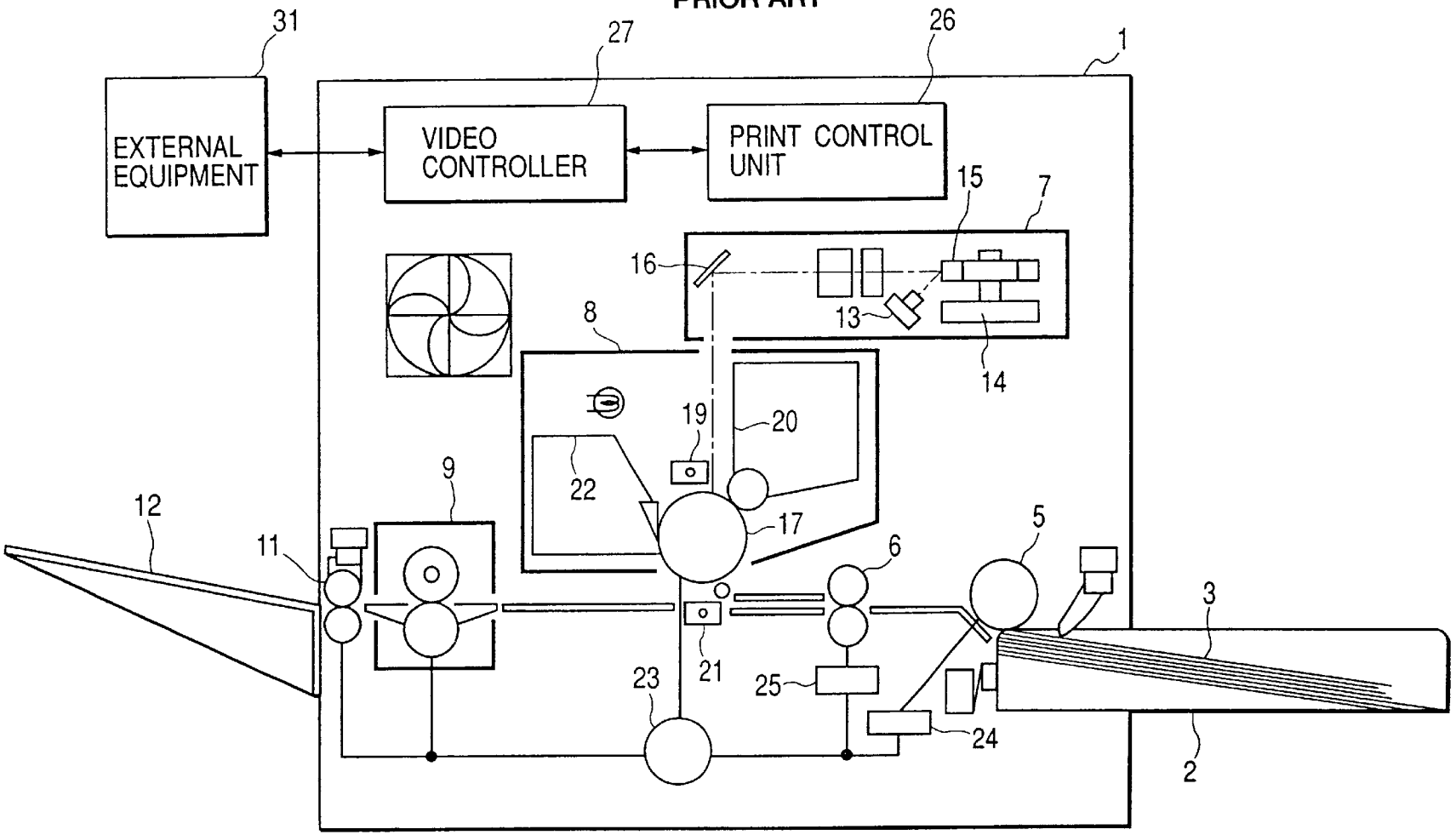
FIG. 12 PRIOR ART
FIG. 12 is a sectional view showing a structure of a multibeam laser printer (common to prior art)
Figures 13A, 13B, 13C, 13D, 13E, 13F, 13G, 13H, 13I:
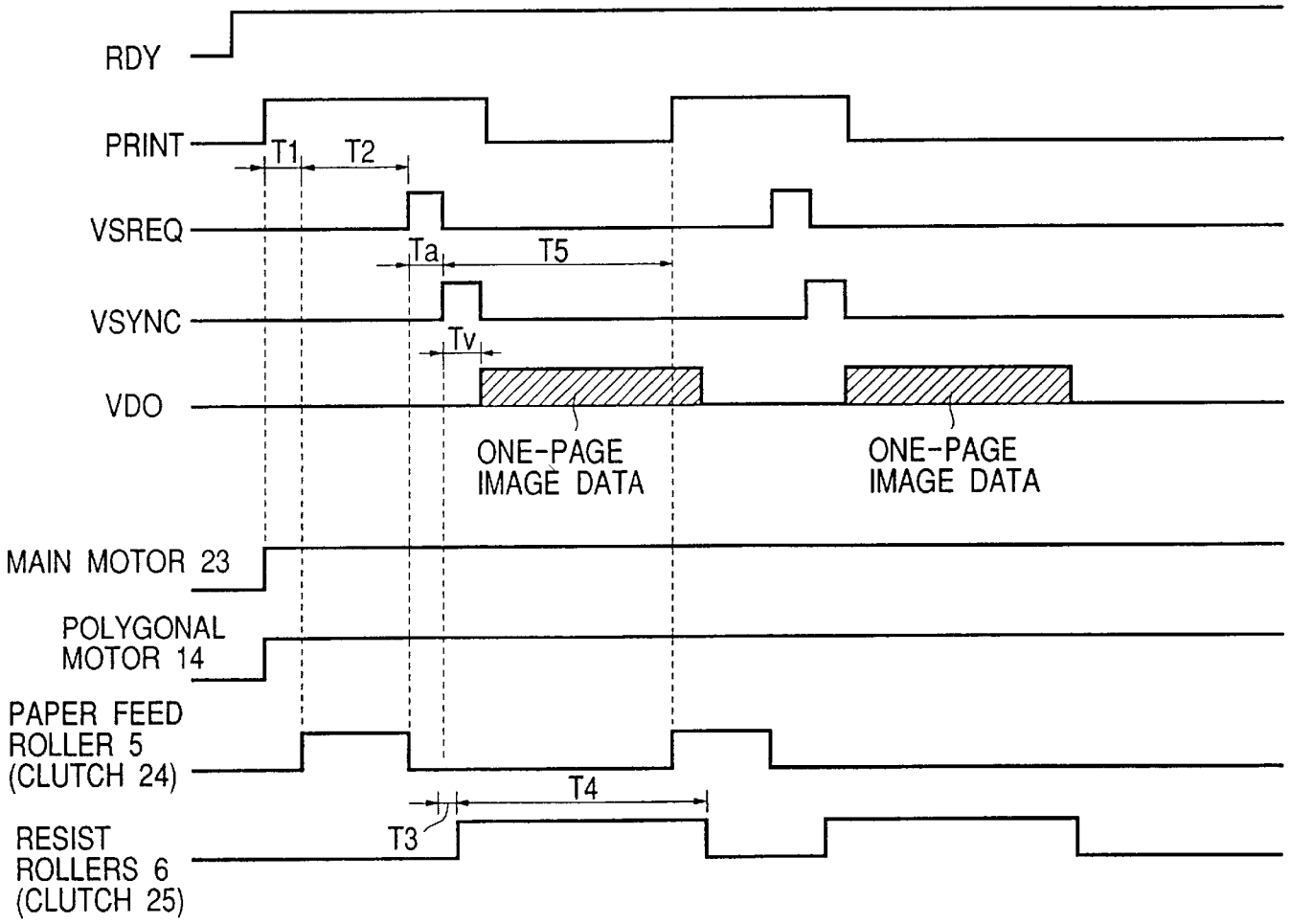
FIG. 13A PRIOR ART
FIG. 13B PRIOR ART
FIG. 13C PRIOR ART
FIG. 13D PRIOR ART
FIG. 13E PRIOR ART
FIG. 13F PRIOR ART
FIG. 13G PRIOR ART
FIG. 13H PRIOR ART
FIG. 13I PRIOR ART
FIGS. 13A, 13B, 13C, 13D, 13E, 13F, 13G, 13H and 13I are time charts for explaining an operation of the multibeam laser printer shown in FIG. 12.
Figure 14:
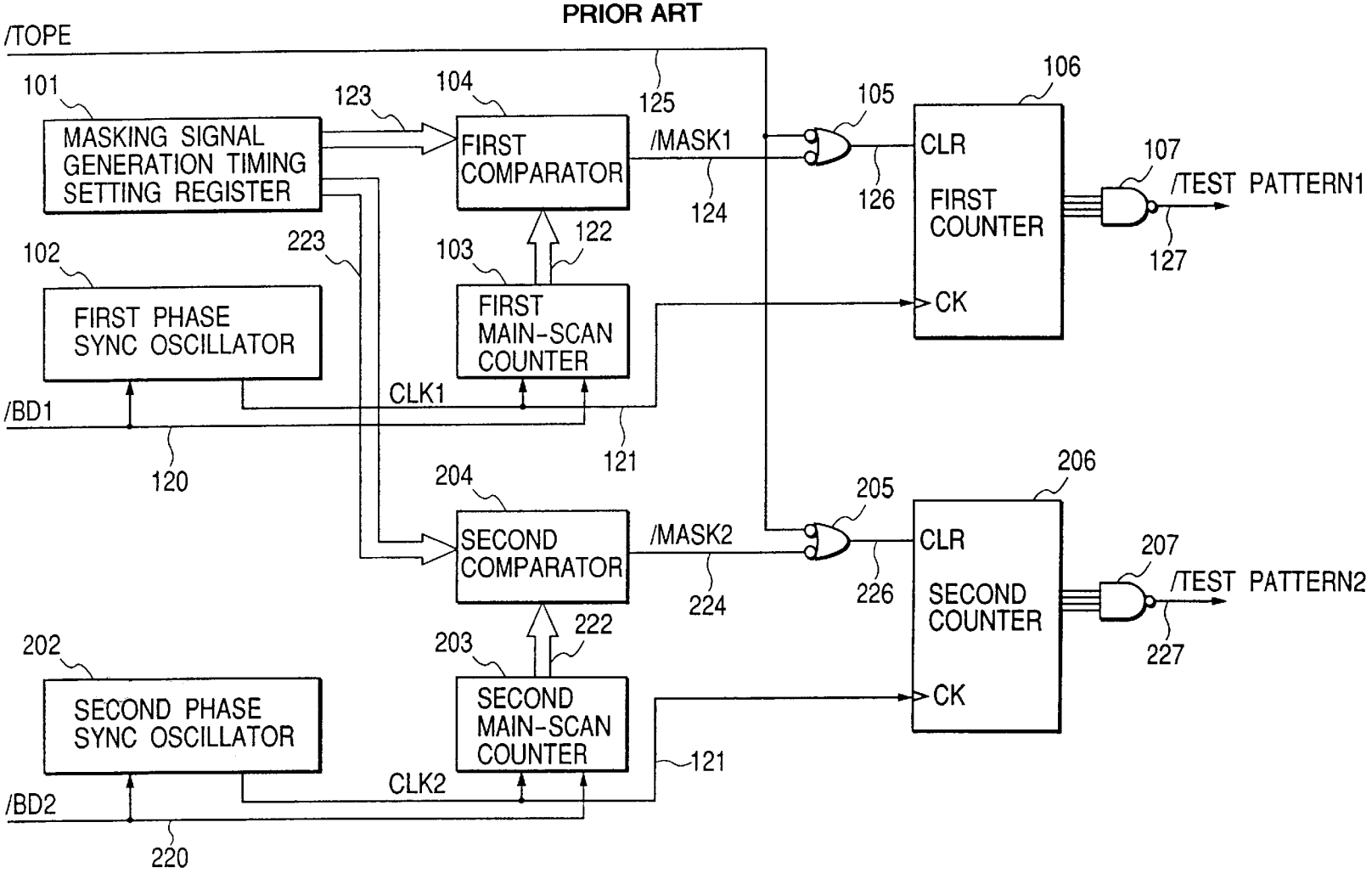
FIG. 14 PRIOR ART
FIG. 14 is a diagram showing a circuit to generate test pattern data in a conventional multibeam laser printer.

Similarly, in synchronism with timing when the /BD1 signal 331 becomes TRUE, the main-scan counter 303 is reset. The counter 303 is reset based on the /BD signal to count the CLK signal 321 and detect which position in a main-scan direction the noticeable (i.e., remarkable) laser beam is being currently scanned. By a comparator 304, an output (i.e., main-scan counter value 322) of this counter 303 is compared with a value 322 previously set in a mask signal timing setting register 301. Then, according to a compared result, a mask signal (/MASK signal) 324 is outputted from the comparator 304. It should be noted that, in the mask signal timing setting register 301, the two values respectively representing main-scan positions for mask release and mask generation have been previously set by a print control unit 26 (FIG. 12). These values and the position to which the laser beam is currently scanning are compared to output the mask signal, thereby controlling writing inhibition in a main-scan horizontal direction. On the other hand, a control signal for writing inhibition in the sub-scan direction is inputted by the print control unit 26 as a /top erase signal (/TOPE signal) 325. These control signals for writing inhibition in the main- and sub-scan directions (i.e., /MASK signal 324 and /TOPE signal 325) are synthesized by a gate 305 to output a writing inhibition signal 326.

The test pattern data is generated by the four-bit counter 306 and an NAND gate 307. In this case, since a bit length of the counter 306 should be selected according to a print pattern, it is unnecessary to always select the four-bit length. When the writing inhibition signal 326 becomes FALSE and thus the writing inhibition is released, the counter 306 start to count the CLK signal 321. Then, when the value obtained from the counter 306 reaches "Fh", a /test print signal 327 becomes TRUE. On the other hand, when the writing inhibition signal 326 is FALSE, the counter 306 is cleared, and the /test print signal 327 surely becomes FALSE. The signal 327 is outputted as a /TEST PATTERN1 signal 334 through a demultiplexer 312, and thus the laser A is turned on or off in response to the outputted signal 334. The demultiplexer 312 outputs the /test print signal 327 to the laser A of a semiconductor laser 13 (FIG. 12) as the /TEST PATTERN1 signal 334, in response to an SEL signal 333 being synchronous with the /BD1 signal 331.

As above, the laser is surely OFF during the writing inhibition, while the /TEST PATTERN1 signal 334 is TRUE for one clock at a 16 clock period during release of the writing inhibition, whereby the laser A records black pixels at a certain interval in the main-scan direction. It should be noted that, while the laser A is being selected, the driving of laser B is inhibited.

On the other hand, during a period when it is being instructed by the SEL signal 330 to select the laser B, the laser B is turned on or off in response to a /TEST PATTERN2 signal 335 through the similar process, and the driving of laser A is inhibited.

In the structure to generate the test pattern data as described above, the plural lasers time-divisionally utilize the test pattern data generation circuit provided only one. Therefore, it is unnecessary to provide the plural test pattern data generation circuits for the respective lasers.

Figure 2:
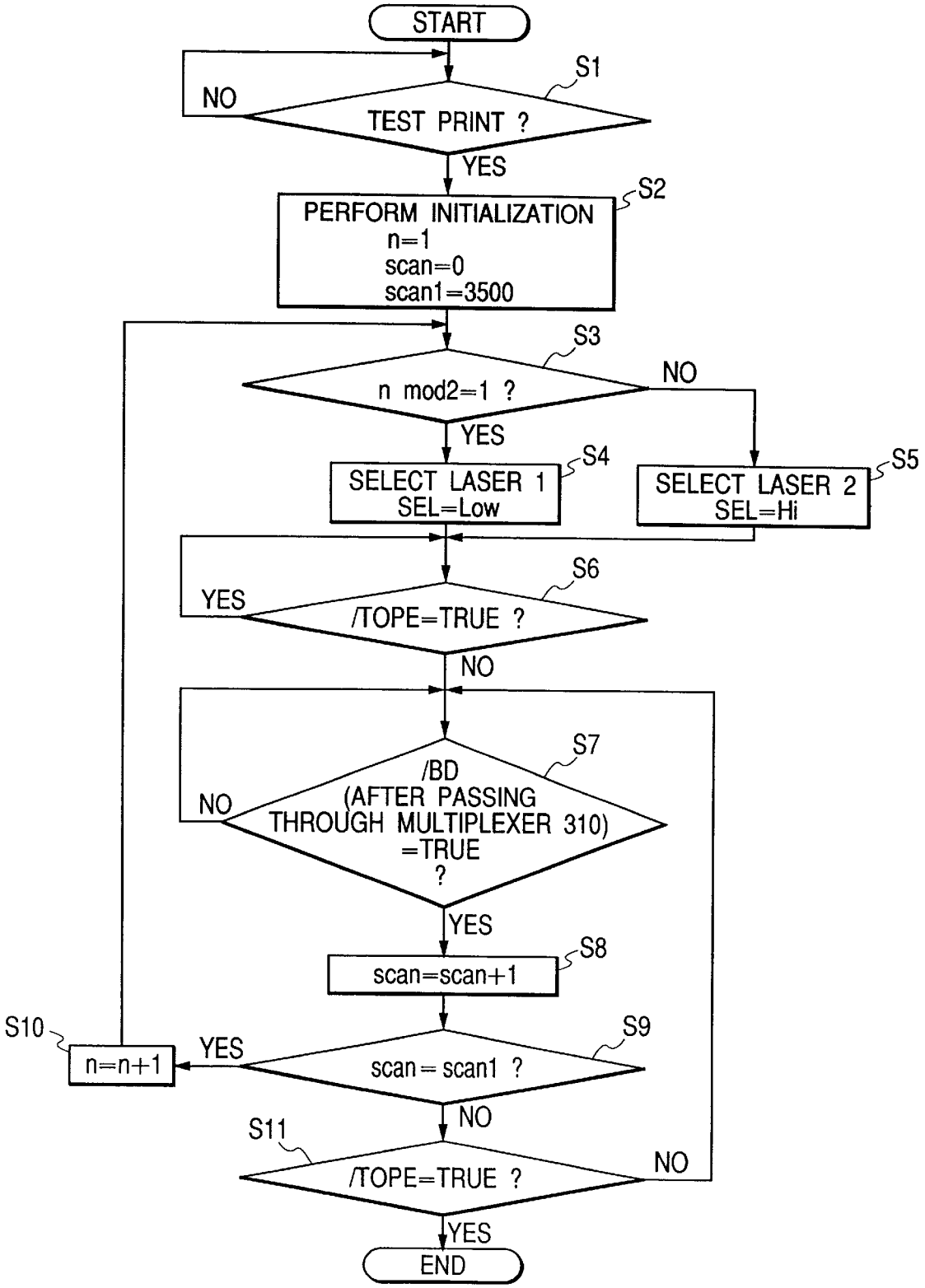
FIG. 2 is a flow chart of an operation to control an SEL signal 330 in the first embodiment.

FIG. 2 is a flow chart showing an operation to control the SEL signal 330 shown in FIG. 1.

Initially, in a step S1, it waits for a test print instruction. If there is the test print instruction, then the flow advances to a step S2 to initialize a laser counter variable "n", a scan variable "scan" and a laser switch value "scan1". Then, the flow advances to a step S3 to select the laser. As a result, the flow advances to a step S4 or a step S5. In the step S4, the select signal (SEL signal) 330 to select the laser A is outputted, while in the step S5, the SEL signal 330 to select the laser B is outputted. After the SEL signal 330 is sent, the flow advances to a step S6 to be on standby until the writing inhibition in the sub-scan direction based on the /TOPE signal 325 is released. If the inhibition is released, the flow advances to a step S7 to be on standby until the /BD signal 320 becomes TRUE after it passes through the multiplexer 310. When the /BD signal 320 becomes TRUE, the flow advances to a step S8 to perform increment of the scan variable "scan" by one. Then, the flow advances to a step S9 to compare the scan variable "scan" with the laser switch value "scan1". If "scan"≠"scan1", the flow advances to a step S10, while if "scan"≠"scan1", the flow advances to a step S11. In the step S10, it performs increment of the laser counter variable "n" by one, and then the flow advances to the step S3. On the other hand, if it is judged in the step S11 that the writing inhibition in the sub-scan direction based on the /TOPE signal 325 is released, the flow advances to the step S7. On the other hand, if the writing inhibition is not released, the process terminates. It should be noted that the laser switch value "scan1" can be arbitrarily set. For example, in case of switching or changing the laser at the center of the paper sheet, the value "scan1" becomes "the number of scan lines until the lines reach the center / 2".

Figure 3:
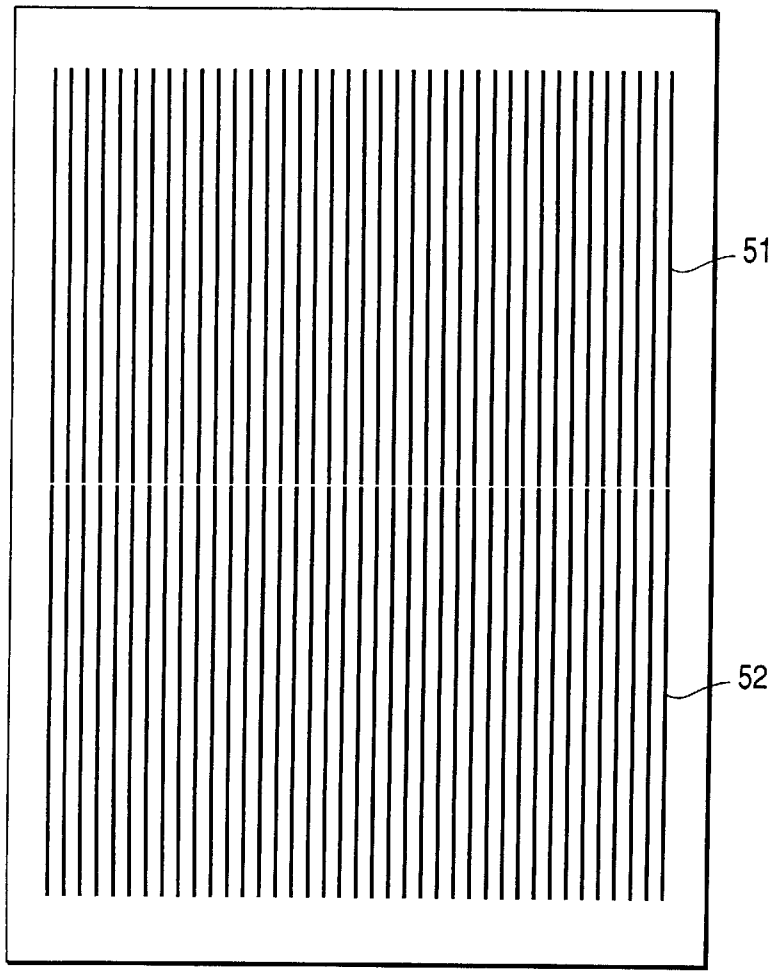
FIG. 3 is a view showing a printed result of a test pattern in an ordinary state in the first embodiment.

FIG. 3 shows an example of a test pattern result which is outputted when the test pattern data generation circuit in the first embodiment operates in a case where every light beam is normal. In FIG. 3, longitudinal lines 51 are printed or drawn in an upper-half area on the paper sheet by the laser A, and longitudinal lines 52 are printed or drawn in a lower-half area by the laser B. The lines 51 and 52 are exposed on a photosensitive drum 17 (FIG. 12) as broken lines each having one-dot space and expanding in a longitudinal direction. However, through the electrostatic process, these lines are actually printed as the lines approximating to solid lines in the longitudinal direction.

Figure 4:
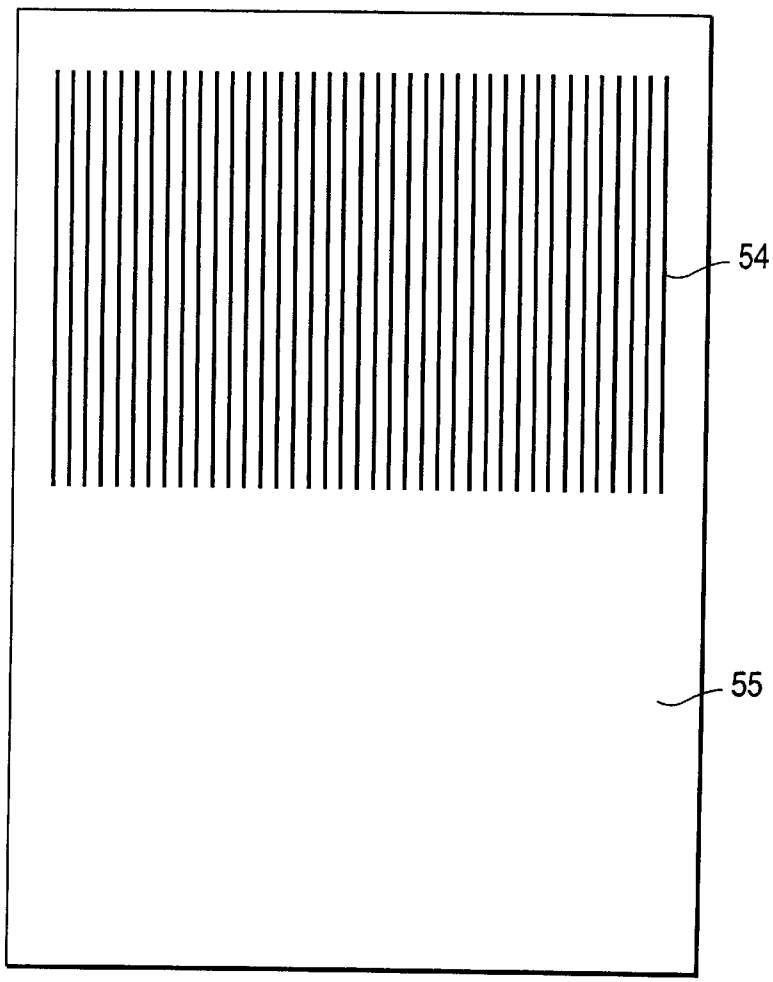
FIG. 4 is a view showing a printed result of the test pattern in a state that one of plural laser beams is not emitted in the first embodiment.

On the other hand, as the abnormal state example being specific when the plural light beams are used, in the case where one of the plural light beams is deteriorated and thus does not completely operate (i.e., example 1 of abnormal state), a test pattern result shown in FIG. 4 can be obtained in the first embodiment. In FIG. 4, since a lower-half area 55 is blank, it can be easily judged that the laser B has been deteriorated. It should be noted that FIG. 4 shows the example in the case where the laser B has been completely deteriorated. That is, in a transitional state before the laser B is completely deteriorated, the area 55 is printed with thin longitudinal lines. By applying the present invention as above, it is possible to generate the test pattern data capable of being detected even in such the transitional state.

Further, as items inspectable by using the longitudinal-line pattern as the test pattern, e.g., possibility of printing, degree of an inclination, degree of jitter in a scanner motor, confirmation of a mask area and the like can be cited. In this case, it should be noted that the confirmation of the mask area can be inspected only in a case where the mask generation circuit is identical between the test printing and the printing based on a /VDO signal. In any case, these items can be confirmed or discriminated from the longitudinal lines 51 and 52 respectively drawn by the lasers A and B both obtained in the first embodiment.

Although the two-beam laser printer is explained by way of example in the first embodiment, the present invention is not limited to such the printer. Namely, the present invention is applicable to a multibeam laser printer in which plural beams are used.

Further, it is explained in the first embodiment the example that one face of one paper sheet is divided into two areas and the test pattern is drawn in each area by one beam. However, the present invention is not limited to such the operation as the test pattern is printed on one face of one sheet. For example, it is possible to draw the test pattern on a first sheet by a first beam and on a second sheet by a second beam, and also possible to draw the pattern on a front face of the sheet by the first beam and on a rear face thereof by the second beam.

Furthermore, an interval between the adjacent longitudinal lines in the longitudinal-line pattern is determined based on the number of bits of the counter 306 or the like. However, it is possible to make the interval variable to generate a longitudinal-line pattern arbitrarily designated by a user every time the test pattern is generated.

(Second Embodiment)

Figure 5:
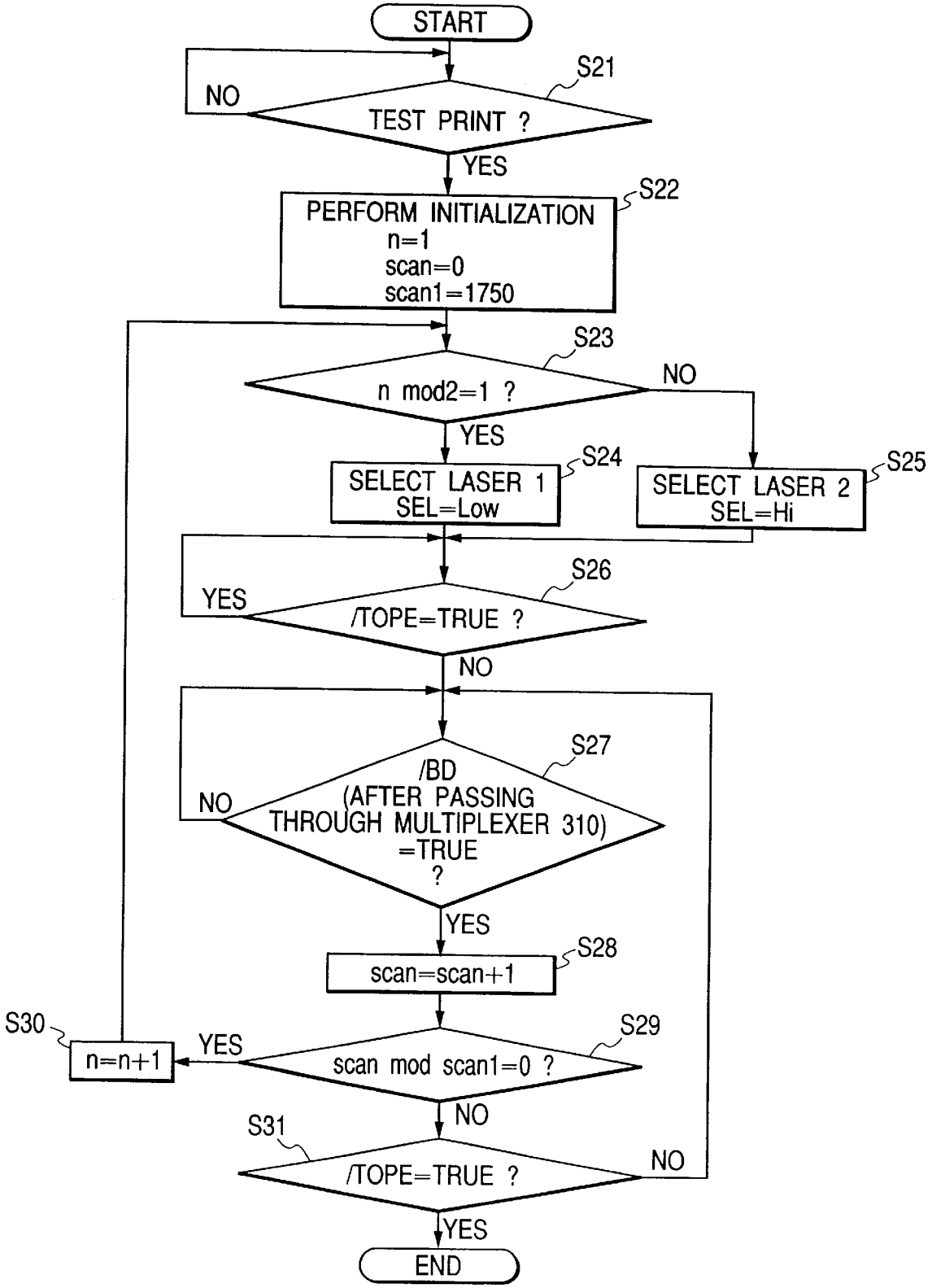
FIG. 5 is a flow chart of an operation to control an SEL signal 330 in the second embodiment.

Subsequently, the second embodiment will be explained with reference to FIG. 5. FIG. 5 is the flow chart showing a control method of the SEL signal 330 shown in FIG. 1. In the second embodiment, an abnormality judgment function in horizontal sync control is added to the functions already explained in the first embodiment.

Initially, in a step S21, it waits for a test print instruction. If there is the test print instruction, then the flow advances to a step S22 to initialize a laser counter variable "n", a scan variable "scan" and a laser switch value "scan1". Then, the flow advances to a step S23 to select the laser. As a result, the flow advances to a step S24 or a step S25. In the step S24, the select signal (SEL signal) 330 to select the laser A is outputted, while in the step S25, the SEL signal 330 to select the laser B is outputted. After the SEL signal 330 is sent, the flow advances to a step S26 to be on standby until the writing inhibition in the sub-scan direction based on the /TOPE signal 325 is released. If the inhibition is released, the flow advances to a step S27 to be on standby until the /BD signal 320 becomes TRUE after it passes through the multiplexer 310. When the /BD signal 320 becomes TRUE, the flow advances to a step S28 to perform increment of the scan variable "scan" by one. Then, the flow advances to a step S29 to compare the scan variable "scan" with the laser switch value "scan1". If "scan mod scan1"=0, the flow advances to a step S30, while if "scan mod scan1"≠0, the flow advances to a step S31. In the step S30, it performs increment of the laser counter variable "n" by one, and then the flow advances to the step S23 again. On the other hand, if it is judged in the step S31 that the writing inhibition in the sub-scan direction based on the /TOPE signal 325 is released, the flow advances to the step S27. On the other hand, if the writing inhibition is not released, the process terminates. Like the first embodiment, the laser switch value "scan1" can be arbitrarily set. For example, in FIG. 6, the total number of scanning during the printing of one sheet is assumed to be 7000 times, whereby the value "scan1" is set to be 1750.

Figure 6:
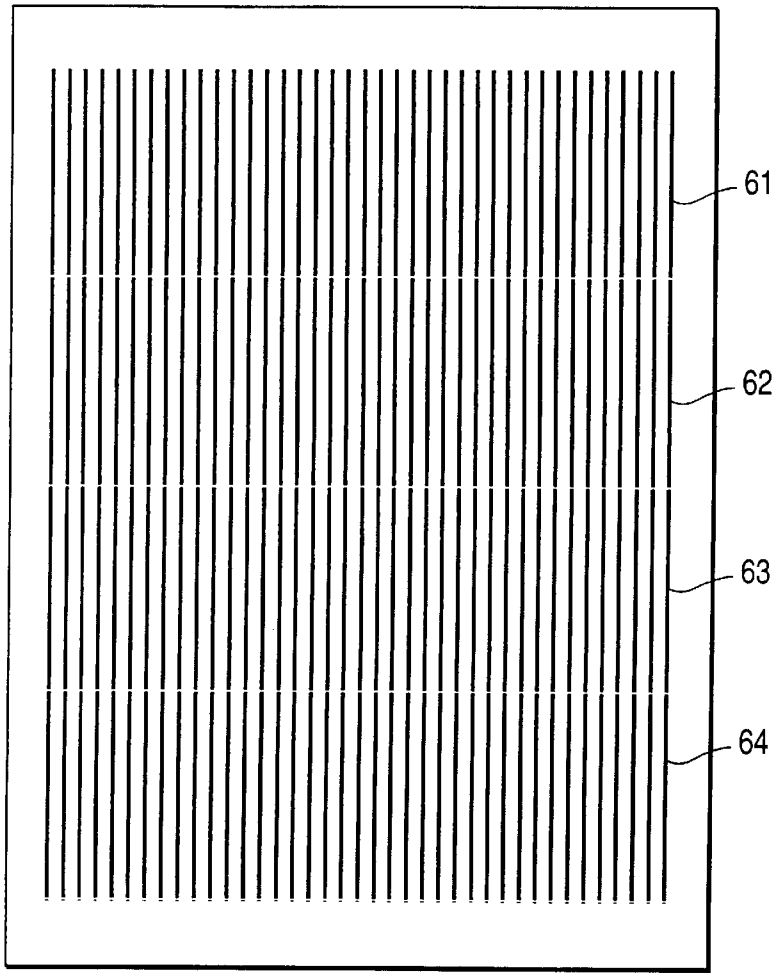
FIG. 6 is a view showing a printed result of a test pattern in an ordinary state in the second embodiment.

FIG. 6 shows an example of a test pattern which is outputted when a test pattern data generation circuit according to the second embodiment operates in a case where every light beam is normal in the sync control. In the test pattern of FIG. 6, longitudinal lines 61 by the laser A, longitudinal lines 62 by the laser B, longitudinal lines 63 by the laser A and longitudinal lines 64 by the laser B are sequentially printed or drawn from the top. Then, the lines 61 to 64 are exposed on a photosensitive drum respectively as broken lines each having one-dot spaces and expanding in a longitudinal direction. However, through the electrostatic process, these lines are actually printed as the lines approximating to solid lines in the longitudinal direction.

Figure 7:
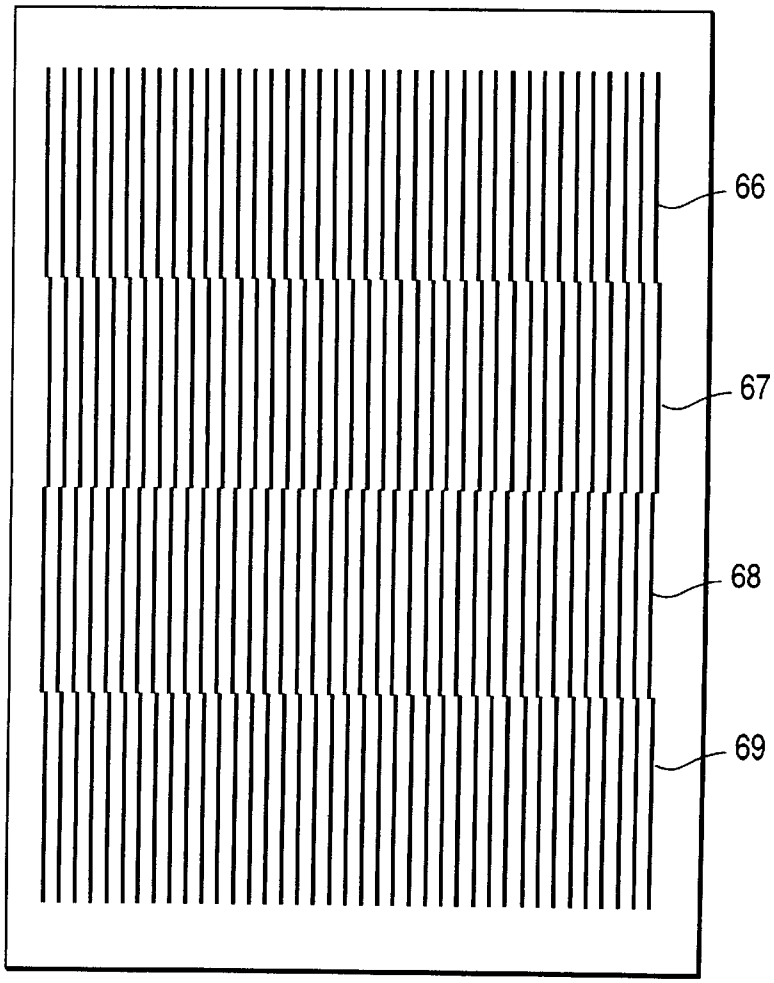
FIG. 7 is a view showing a printed result of the test pattern in a state that horizontal synchronism is displaced between two laser beams in the second embodiment.
Figure 8:
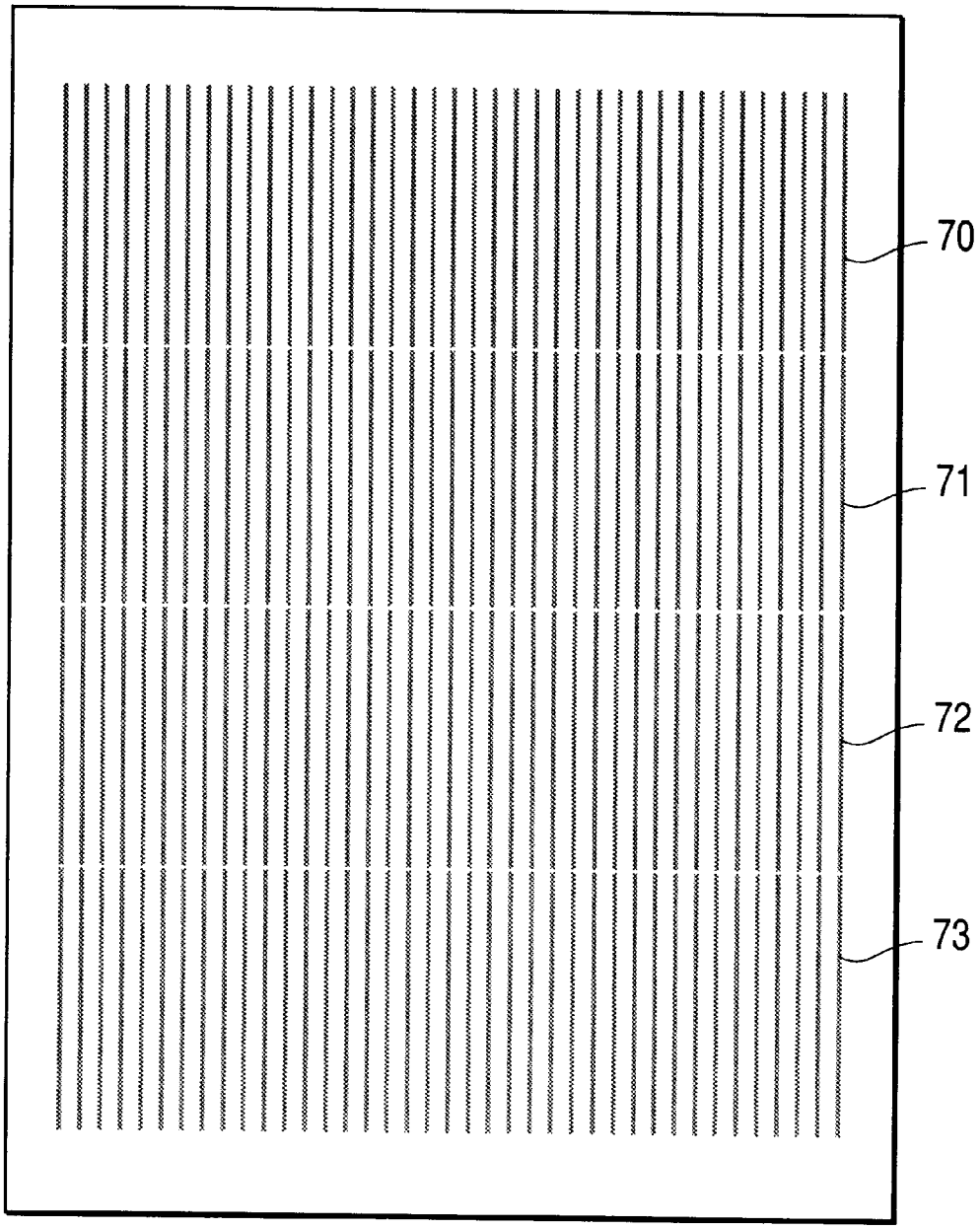
FIG. 8 is a view showing a printed result of the test pattern in a state that jitter in a BD signal detection means is large in the second embodiment.

On the other hand, as the abnormal state example being specific when the plural light beams are used, in the case where abnormality occurs in the horizontal sync control (i.e., example 2 of abnormal state), and further in a case where, e.g., writing timing of two beams in a main-scan direction is asynchronous, a test pattern result shown in FIG. 7 is obtained. Further, the jitters in a means for detecting the /BD signal (/BD1 signal 120 and /BD2 signal 220) are relatively large, a test pattern result shown in FIG. 8 is obtained.

As described above, according to the second embodiment, in addition to the effect derived in the first embodiment, a further specific effect can be derived by repeatedly providing an area on which the printing is performed by using only one beam. This further specific effect is that, when horizontal sync can not be obtained, it is possible to clearly specify the reason of such inconvenience, i.e., to judge whether the horizontal sync of one of the two beams can not be obtained or the jitters in the means for detecting the /BD signal (/BD1 signal 120 and /BD2 signal 220) are large.

Like the first embodiment, although the two-beam laser printer is explained by way of example in the second embodiment, the present invention is not limited to such the printer. Namely, the present invention is applicable to a multibeam laser printer in which plural beams are used.

Further, it is explained in the second embodiment the example that one face of one paper sheet is divided into two areas and the test pattern is drawn or printed in each area by one beam. However, the present invention is not limited to such the operation as the test pattern is printed on one face of one sheet. For example, it is possible to draw the test pattern on a first sheet by a first beam and on a second sheet by a second beam, and also possible to draw the pattern on a front face of the sheet by the first beam and on a rear face thereof by the second beam.

Furthermore, although a laser switch interval is determined by the laser switch value "scan1" in the second embodiment, the present invention is not always fixed to such a determination operation. That is, the laser switch interval may be designated by a user every time the test pattern is generated. Furthermore, as described in the first embodiment, it is possible to make variable the interval between the adjacent longitudinal lines in the longitudinal-line pattern, to generate a longitudinal-line pattern arbitrarily designated by the user every time the test pattern is generated.

(Third Embodiment)

In the third embodiment, a solid-color image such as a halftone image or the like is recorded in each of plural areas by one of plural lasers.

Figure 9:
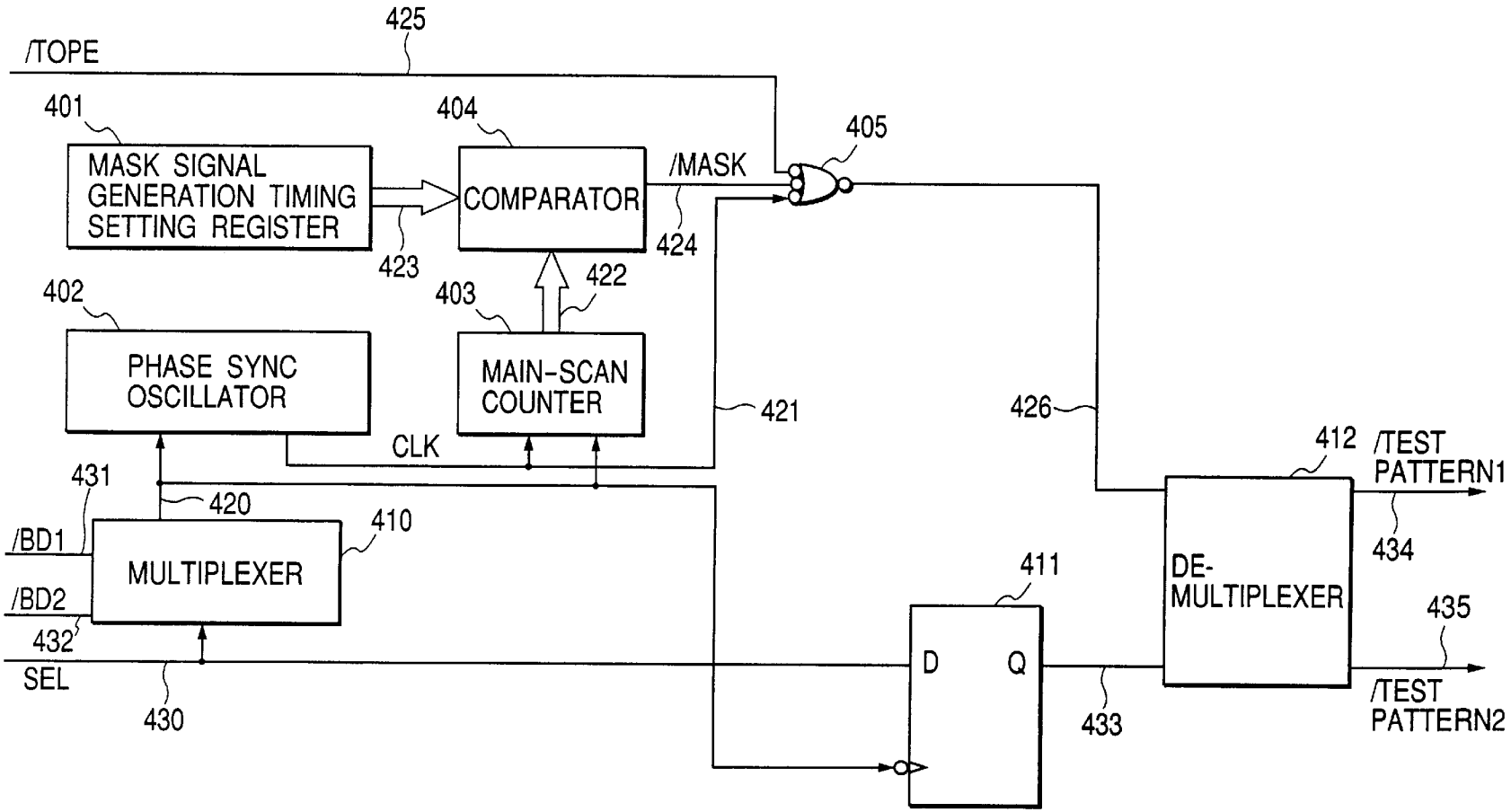
FIG. 9 is a diagram showing a circuit to generate test pattern data according to a third embodiment of the present invention.

FIG. 9 is a block diagram showing a structure of a test pattern data generation circuit by which the third embodiment is realized. In FIG. 9, an SEL signal 430 is a signal for selecting the laser to which test printing is hereafter performed. The SEL signal 430 is inputted to a multiplexer 410 and also to a BD signal sync circuit 411. The multiplexer 410 which received the SEL signal 430 acts to connect an input signal (i.e., /BD1 signal 431 or /BD2 signal 432) required for the laser to be driven hereafter, with the test pattern generation circuit.

Hereinafter, a case where the SEL signal 430 for driving a laser A was inputted to the multiplexer 410 will be explained. The /BD1 signal (signal 420) outputted from the multiplexer 410 is inputted to a phase sync oscillator 402, a main-scan counter 403 and the BD signal sync circuit 411. At timing when the /BD1 signal 431 becomes TRUE, the main-scan counter 403 is reset. Similarly, at timing when the /BD1 signal 431 becomes TRUE, the BD signal sync circuit 411 sends the held SEL signal 430 to a demultiplexer 412 as an SEL signal 433. The demultiplexer 412 which received the SEL signal 433 synchronous with the /BD1 signal 431 outputs an inputted /test print signal 426 to the laser A as a /TEST PATTERN1 signal 434. Further, by using as a trigger the change that the /BD1 signal 431 becomes TRUE, the oscillator 402 starts to generate an image clock signal (CLK signal) 421 synchronous with the /BD1 signal 431. The CLK signal 421 is inputted to the main-scan counter 403 and a NOR gate 405, and the counter 403 counts the number of pulses of the CLK signal 421. By a comparator 404, a main-scan counter value 422 is compared with a value 423 set in a mask signal generation timing setting register 401. As a result of such comparison, a /mask signal (/MASK signal) 424 is outputted from the comparator 404. By a print control unit, two counter values at mask release and mask generation have been previously set in the register 401, whereby writing inhibition control in a horizontal direction is performed. On the other hand, writing inhibition control in a vertical direction is performed based on a /top erase signal (/TOPE signal) 425 sent from the print control unit. The /MASK signal 424, the /TOPE signal 425 and the CLK signal 421 are inputted to the NOR gate 405. When the writing inhibition is released, the NOR gate 405 outputs the /test pattern signal 426 obtained by inverting the CLK signal 421. The signal 426 is then outputted through the demultiplexer 412 as the /TEST PATTERN1 signal 434 to turn on and off the laser A. While the laser A is being selected, driving of a laser B is inhibited.

On the other hand, while it is being instructed by the SEL signal 430 to select the laser B, the laser B is turned on and off according to a /TEST PATTERN2 signal 435 and also driving of the laser A is being inhibited in the same manner as above.

The SEL signal shown in FIG. 9 is generated in an operation according to the flow chart of FIG. 2 to control the SEL signal (but substituting description of multiplexer 410 for that of multiplexer 310).

Figure 10:
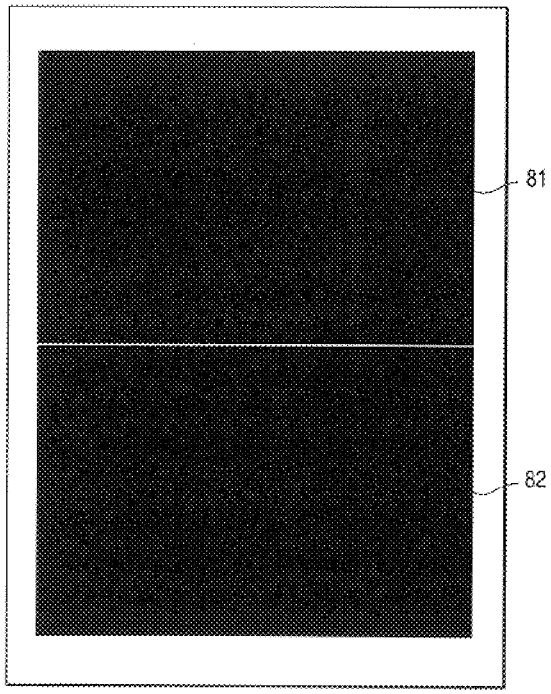
FIG. 10 is a view showing a printed result of a test pattern in an ordinary state in the third embodiment.

FIG. 10 shows an example of a test pattern which is outputted when the test pattern data generation circuit operates in the third embodiment in a case where all the light beams are controlled to be uniform in intensity. In FIG. 10, a halftone 81 by the laser A is printed on an upper area on the sheet, and a halftone 82 by the laser B is printed on a lower area thereon.

Figure 11:
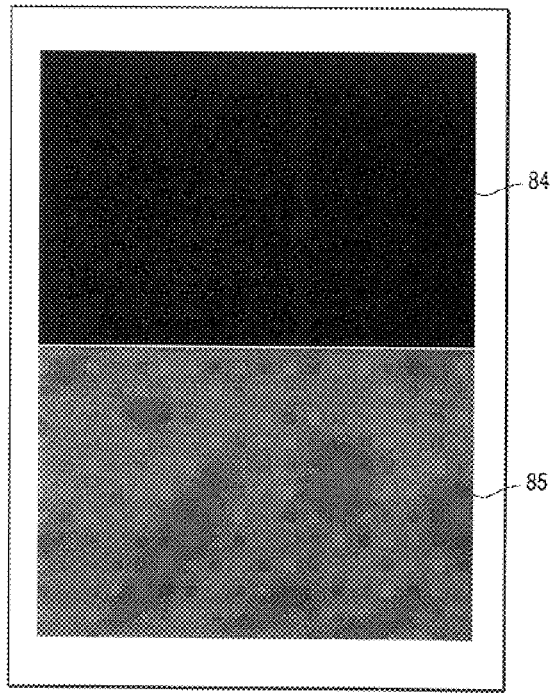
FIG. 11 is a view showing a printed result of the test pattern in a state that intensity is not uniform between two laser beams in the third embodiment.

On the other hand, as the abnormal state example being specific when the plural light beams are used, it is supposed a case where the light quantities of the plural beams are not uniform (i.e., example 3 of abnormal state). For example, the intensity of the laser beam B is weaker than its reference value, a test pattern result shown in FIG. 11 is obtained in the third embodiment. That is, as shown in FIG. 11, since a density of a lower-half area 85 is thinner than that of an upper-half area 84, it can be relatively detected that the intensity of the laser beam B becomes weak.

As items inspectable by using a halftone pattern as the test pattern, e.g., possibility of printing, confirmation of density unevenness, confirmation of a mask area and the like can be cited. In this case, it should be noted that the confirmation of the mask area is inspectable only in a case where the mask generation circuit is identical between the test printing and the printing based on a /VDO signal. In any case, these items can be also confirmed or discriminated from the halftone pattern 81 drawn by the laser A and the halftone pattern 82 drawn by the laser B.

As described above, according to the third embodiment, dispersion in the image density due to dispersion in the laser beam intensity can be detected from the halftone pattern drawn by one laser beam in a multibeam laser printer.

Like the above embodiments, although the two-beam laser printer is explained by way of example in the third embodiment, the present invention is not limited to such the printer. Namely, the present invention is applicable to the multibeam laser printer in which the plural beams are used.

Further, it is explained in the third embodiment the example that one face of one paper sheet is divided into two areas and the halftone pattern is printed in each area by one beam. However, the present invention is not limited to such the operation as the halftone pattern is printed on one face of one sheet. For example, it is possible to print the halftone pattern on a first sheet by a first beam and on a second sheet by a second beam, and also possible to print the pattern on a front face of the sheet by the first beam and on a rear face thereof by the second beam.

(Other Embodiments)

In the above first to third embodiments, it has been explained the structure that the test pattern data generated by one test pattern data generation circuit is inputted to any one of the plural lasers. However, it is possible to provide the test pattern data generation circuit corresponding to each of the plural lasers. Further, it is possible to previously store the test patterns shown in FIGS. 3, 6 and 10 in an image memory and then perform printing based on the stored patterns.

As above, there have been explained the examples in which the various test patterns are recorded according to the various structures. However, it is still more preferable to combine these structures to enable switching of generation of the various patterns according to an instruction signal externally inputted.

According to the above embodiments, in case of recording the test pattern for the optical printer which performs the image formation by using the plural light beams, it is possible to record the test pattern by which the abnormality state of the light beam can be correctly detected. Further, it is possible to record the test pattern at low cost. Furthermore, it is possible to record the test pattern allowing the user to detect which light beam the abnormal state occurs.

As above, the present invention has been explained with reference to the several preferred embodiments. However, the present invention is not limited to these embodiments, and various modifications and application are possible within the appended claims.

What is claimed is:

1. An electrophotographic apparatus comprising:

plural emission means each for emitting a light beam;

drive means for driving each of the plural light beams according to inputted image data;

scan means for performing scanning on a plurality of scan paths mutually different on a common photosensitive medium, with the plural light beams; and generation means for generating test pattern data, said drive means driving each light beam according to the test pattern data to record a test pattern, wherein said drive means drives any one of the plural light beams within a predetermined area on said photosensitive medium to record the test pattern.

2. An electrophotographic apparatus comprising:

plural emission means each for emitting a light beam;

drive means for driving each of the plural light beams according to inputted image data;

scan means for performing scanning on a plurality of scan paths mutually different on a common photosensitive medium, with the plural light beams; and generation means for generating test pattern data, said drive means driving each light beam according to the test pattern data to record a test pattern, wherein said apparatus further comprises selection means for selecting any one of the plural light beams, and said drive means drives, within a predetermined area on said photosensitive medium, the light beam selected by said selection means to record the test pattern.

3. An electrostatic apparatus comprising:

plural emission means each for emitting a light beam;

drive means for driving each of the plural light beams according to inputted image data;

scan means for performing scanning on a plurality of scan paths mutually different on a common photosensitive medium, with the plural light beams; and generating means for generating test pattern data, said drive means driving each light beam according to the test pattern data to record a test pattern, wherein plural areas each corresponding to each of the plural light beams are provided, and said drive means drives, within each of the plural areas on said photosensitive medium, the light beam corresponding to said area to record the test pattern.

4. An apparatus according to claim 3, wherein the test pattern is a longitudinal-line image.

5. An apparatus according to claim 4, wherein the plural areas are neighboring in a sub-scan direction.

6. An apparatus according to claim 3, wherein the test pattern is a half-tone image.

7. An electrophotographic apparatus comprising:

plural emission means each for emitting a light beam;

drive means for driving each of the plural light beams according to inputted image data; and scan means for performing scanning on a common photosensitive medium with the plural light beams, wherein a test pattern is recorded in a predetermined area on said photosensitive medium by using any one of said plural emission means.

8. An apparatus according to claim 7, wherein the test pattern is a longitudinal-line image.

9. An apparatus according to claim 7, wherein the test pattern is a half-tone image.

10. An electrophotographic apparatus comprising:

plural emission means each for emitting a light beam;

drive means for driving each of the plural light beams according to inputted image data; and scan means for performing scanning on a common photosensitive medium with the plural light beams, wherein a test pattern is recorded in each of the plural areas on said photosensitive medium by using any one of said plural emission means.

11. An apparatus according to claim 10, wherein the test pattern is a longitudinal-line image.

12. An apparatus according to claim 11, wherein the plural areas are neighboring in a sub-scan direction.

13. An apparatus according to claim 10, wherein the test pattern is a half-tone image.

14. A test pattern recording method for an electrophotographic apparatus which emits plural light beams, drives each of the plural light beams according to inputted image data, and performs scanning on a plurality of scan paths mutually different on a common photosensitive medium with the plural light beams, said method comprising:

a generation step of generating test pattern data; and a recording step of driving within a predetermined area on said photosensitive medium any one of the plural light beams according to the test pattern data generated in said generation step, to record a test pattern.

15. A test pattern recording method for an electrophotographic apparatus which emits plural light beams, drives each of the plural light beams according to inputted image data, and performs scanning on a plurality of scan paths mutually different on a common photosensitive medium with the plural light beams, said method comprising:

a selection step of selecting any one of the plural light beams;

a generation step of generating test pattern data; and a recording step of driving within a predetermined area on said photosensitive medium the light beam selected in said selection step, according to the test pattern data generated in said generation step, to record a test pattern.

16. A test pattern recording method for an electrophotographic apparatus which emits plural light beams, drives each of the plural light beams according to inputted image data, and performs scanning on a plurality of scan paths mutually different on a common photosensitive medium with the plural light beams, said method comprising:

a generation step of generating test pattern data; and a recording step of providing plural predetermined areas each corresponding to each of the plural light beams, and driving within each of the plural predetermined areas on said photosensitive medium the light beam corresponding to said area according to the test pattern data generated in said generation step, to record the test pattern.

17. A method according to claim 16, wherein the test pattern is a longitudinal-line image.

18. A method according to claim 17, wherein the plural predetermined areas are neighboring in a sub-scan direction.

19. A method according to claim 16, wherein the test pattern is a half-tone image.

20. A test pattern recording method for an electrophotographic apparatus which emits plural light beams, drives each of the plural light beams according to inputted image data, and performs scanning on a common photosensitive medium with the plural light beams, wherein a test pattern is recorded in a predetermined area on said photosensitive medium by using any one of plural emission means.

21. A method according to claim 20, wherein the test pattern is a longitudinal-line image.

22. A method according to claim 20, wherein the test pattern is a half-tone image.

23. A test pattern recording method for an electrophotographic apparatus which emits plural light beams, drives each of the plural light beams according to inputted image data, and performs scanning on a common photosensitive medium with the plural light beams, wherein a test pattern is recorded in each of plural areas on said photosensitive medium by using any one of plural emission means.

24. A method according to claim 23, wherein the test pattern is a longitudinal-line image.

25. A method according to claim 24, wherein the plural areas are neighboring in a sub-scan direction.

26. A method according to claim 23, wherein the test pattern is a half-tone image.

* * * * *

UNITED STATES PATENT AND TRADEMARK OFFICE

CERTIFICATE OF CORRECTION

PATENT NO. : 6,236,417 B1
DATED : May 22, 2001
INVENTOR(S) : Kenichi Fujii et al.

Figures 15A, 15B, 15C, 15D, 15E, 15F, 15G, 15H, 15I, 15J:
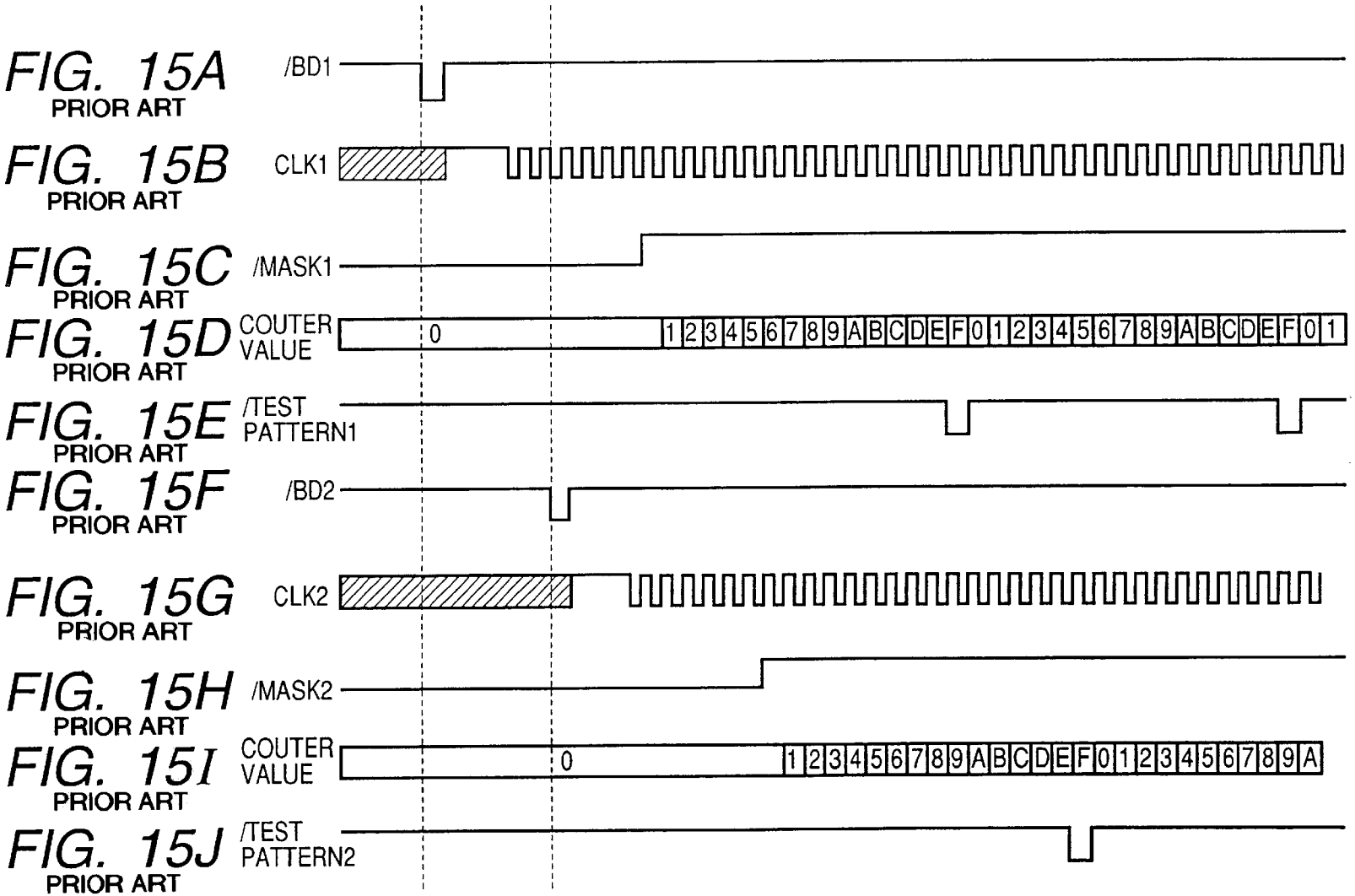
FIG. 15A PRIOR ART
FIG. 15B PRIOR ART
FIG. 15C PRIOR ART
FIG. 15D PRIOR ART
FIG. 15E PRIOR ART
FIG. 15F PRIOR ART
FIG. 15G PRIOR ART
FIG. 15H PRIOR ART
FIG. 15I PRIOR ART
FIG. 15J PRIOR ART
FIGS. 15A, 15B, 15C, 15D, 15E, 15F, 15G, 15H, 15I and 15J are time charts for explaining an operation of the test pattern data generation circuit of the conventional multibeam laser printer shown in FIG. 14.
Figure 17:
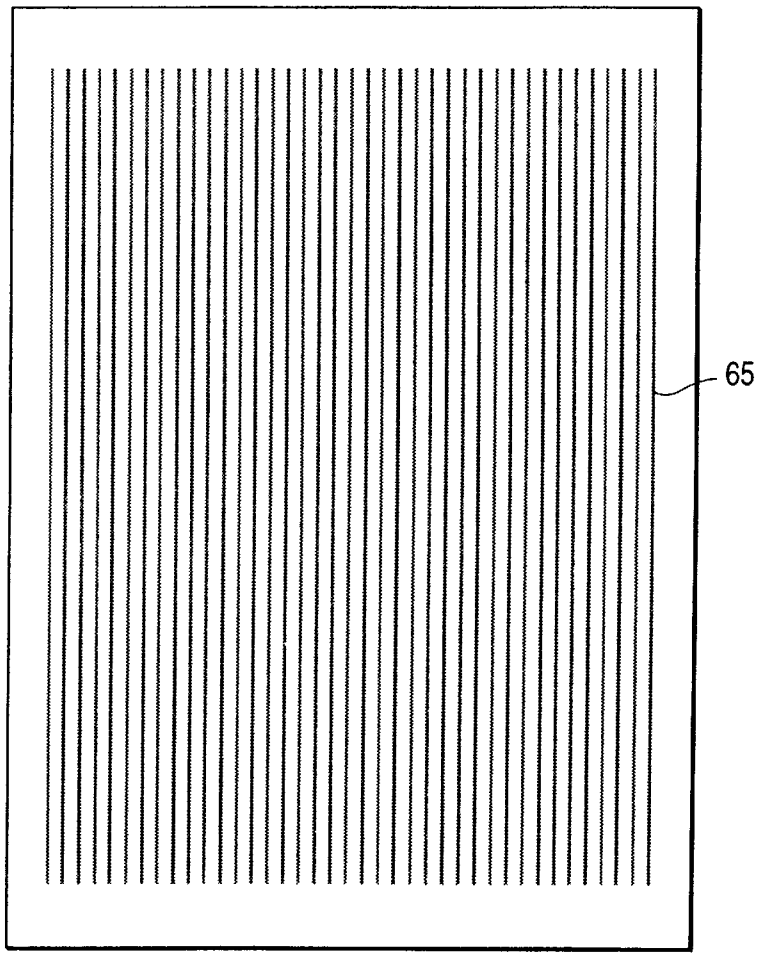
FIG. 17 PRIOR ART
FIG. 17 is a view showing a printed result of the conventional test pattern in a state that abnormality occurs in horizontal sync control of the laser beam.
Figure 16:
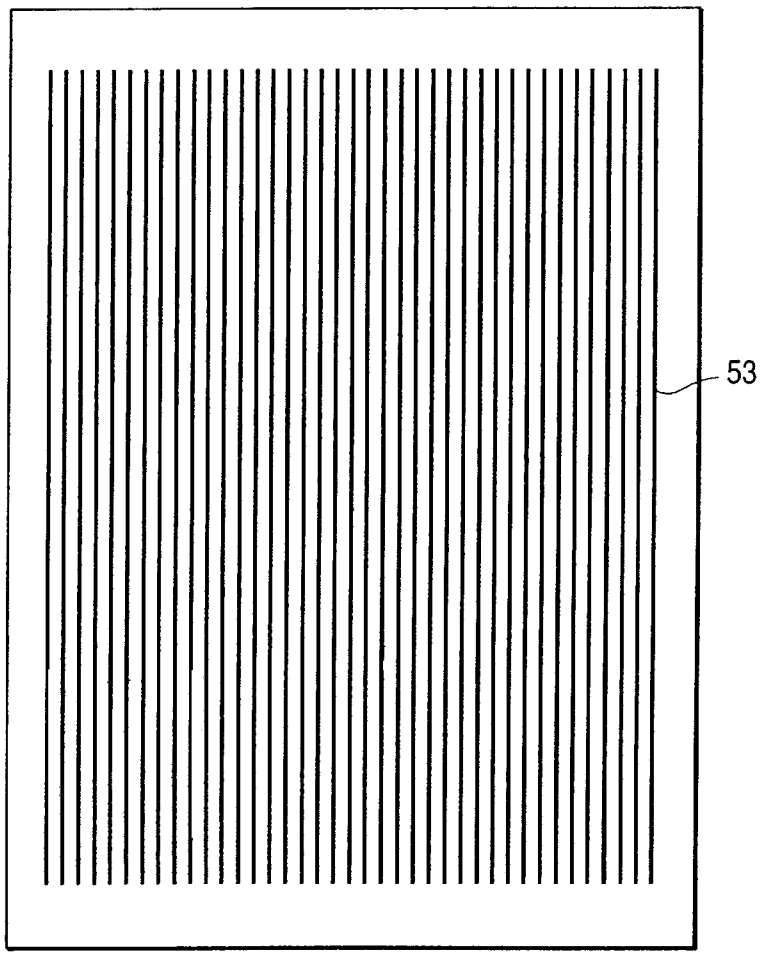
FIG. 16 PRIOR ART
FIG. 16 is a view showing a printed result of a conventional test pattern in a state that one of the laser beams is not emitted.
Figure 18:
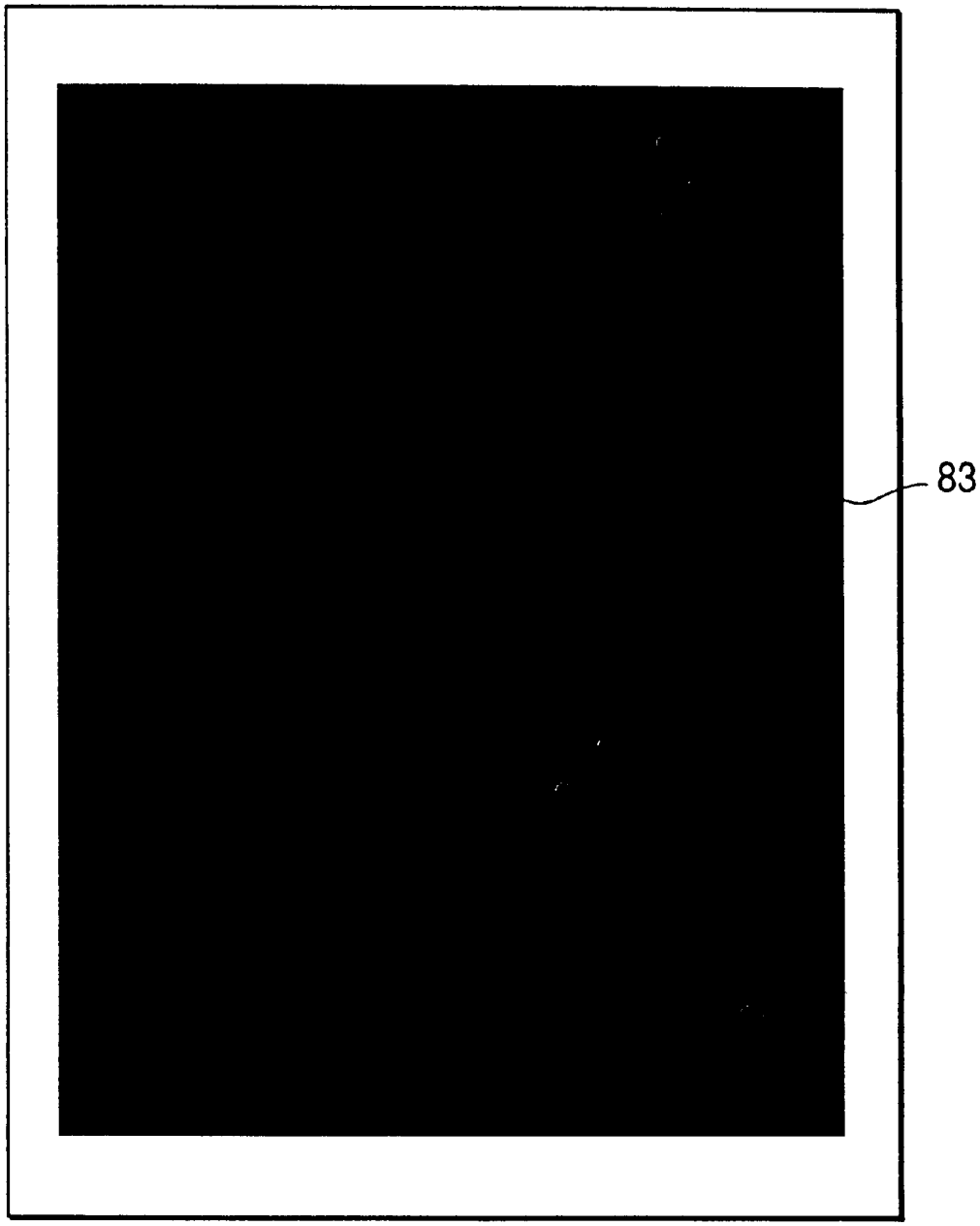
FIG. 18 PRIOR ART
FIG. 18 is a view showing a printed result of the conventional test pattern in a state that intensity is not uniform between the two laser beams.

It is certified that error appears in the above-identified patent and that said Letters Patent is hereby corrected as shown below:

Drawings,
Sheet 12, Figure 15D, "COUTER" should read -- COUNTER --; and
Sheet 12, Figure 15I, "COUTER" should read -- COUNTER --.

Column 1,
Line 17, "the" should read -- a --.

Column 2,
Line 44, "resister" should read -- register --.

Column 3,
Line 48, "the" should read -- a --.

Column 4,
Line 42, "which" (second occurrence) should read -- in which --.

Column 5,
Line 7, "beans" should read -- beams --; and
Line 16, "the" (first occurrence) should read -- an --.

Column 6,
Line 33, "being neighboring to" should read -- neighboring --.

Column 7,
Line 21, "start" should read -- starts --; and
Line 48, "one." should read -- once. --.

Column 8,
Line 34, "been" should be deleted;
Line 36, "been" should be deleted;
Line 41, "the" should read -- a --;
Line 55, "the" (first occurrence) should read -- a --; and
Line 61, "the" (second occurrence) should read -- an --.

Column 9,
Line 57, "to" should be deleted.

UNITED STATES PATENT AND TRADEMARK OFFICE

CERTIFICATE OF CORRECTION

PATENT NO. : 6,236,417 B1
DATED : May 22, 2001
INVENTOR(S) : Kenichi Fujii et al.

It is certified that error appears in the above-identified patent and that said Letters Patent is hereby corrected as shown below:

Column 10,
Line 6, "can not" should read -- cannot --;
Line 8, "can not" should read -- cannot --;
Line 13, "the" (second occurrence) should read -- a --; and
Line 20, "the" (first occurrence) should read -- a --.

Column 12,
Line 3, "the" (first occurrence) should read -- an --;
Line 31, "which" should read -- in which --; and
Line 35, "application" should read -- applications --.

Signed and Sealed this

Thirtieth Day of April, 2002

*Attest:*

*Attesting Officer*

JAMES E. ROGAN
*Director of the United States Patent and Trademark Office*